US007460795B2

(12) United States Patent
Kimura et al.

(10) Patent No.: US 7,460,795 B2
(45) Date of Patent: Dec. 2, 2008

(54) IMAGE FORMING APPARATUS HAVING A DETACHABLY MOUNTABLE IMAGE FORMING UNIT

(75) Inventors: Kuniyasu Kimura, Toride (JP); Eiichi Motoyama, Shinjuku-ku (JP); Hiroaki Tomiyasu, Toride (JP); Takahiko Yamaoka, Kashiwa (JP); Yuichi Yamamoto, Abiko (JP)

(73) Assignee: Canon Kabushiki Kaisha (JP)

( * ) Notice: Subject to any disclaimer, the term of this patent is extended or adjusted under 35 U.S.C. 154(b) by 300 days.

(21) Appl. No.: 11/283,349

(22) Filed: Nov. 18, 2005

(65) Prior Publication Data

US 2006/0133835 A1 Jun. 22, 2006

(30) Foreign Application Priority Data

Nov. 18, 2004 (JP) ..... 2004-334802

(51) Int. Cl.
*G03G 15/00* (2006.01)

(52) U.S. Cl. ..... 399/12; 399/13; 399/24; 399/25

(58) Field of Classification Search ..... 399/12, 399/13, 24, 25
See application file for complete search history.

(56) References Cited

U.S. PATENT DOCUMENTS

2002/0164169 A1 11/2002 Arai et al.
2004/0105689 A1 * 6/2004 Shimura et al. ..... 399/12

FOREIGN PATENT DOCUMENTS

| | | | |
|---|---|---|---|
| JP | H01-181039 | U | 12/1989 |
| JP | 5-61393 | A | 3/1993 |
| JP | 6-51585 | A | 2/1994 |
| JP | 6-118736 | A | 4/1994 |
| JP | 9-73254 | A | 3/1997 |
| JP | 9-185236 | A | 7/1997 |

* cited by examiner

*Primary Examiner*—David M Gray
*Assistant Examiner*—Ryan D Walsh
(74) *Attorney, Agent, or Firm*—Rossi, Kimms & McDowell, LLP

(57) ABSTRACT

An image forming apparatus for carrying out an image forming process with a detachably mountable image forming unit mounted thereon, when the mounting of the image forming unit has been detected, whether the mounted image forming unit is a new one is discriminated. Then, unit control information held by an information holding portion for holding unit control information corresponding to the image forming unit is updated on the basis of the results of discrimination at the last time and this time. By such a construction, image formation becomes executable on the mounted image forming unit always in an optimized state.

9 Claims, 7 Drawing Sheets

IMAGE FORMING APPARATUS HAVING A DETACHABLY MOUNTABLE IMAGE FORMING UNIT

BACKGROUND OF THE INVENTION

1. Field of the Invention

The invention relates to an image forming apparatus using an electrophotographic process such as, for example, a printer or a copying machine.

2. Description of the Related Art

Generally in an image forming apparatus utilizing an electrophotographic printing method, a photoconductive drum and a cleaner and a developing unit around the drum are made into a unit, which in turn is constructed so as to be interchangeable with respect to a printer main body, i.e., an image forming apparatus main body. This unit is expendables and need be interchanged when its life expires. In order to inform a user that the interchange of the unit is necessary, the printer has a rotary part, e.g. a counter for counting the cumulative number of revolutions of the photoconductive drum. When the count value of the counter reaches a predetermined value, the printer displays a life alarm indicating that the interchange of a corresponding unit is necessary. By this alarm, the user can interchange the unit at an appropriate time.

When an old unit is interchanged with a new unit, it is necessary to reset a counter for measuring the life of the photoconductive drum, and change charging potential to be applied in accordance with a new drum, and a table for converting image data into density information.

In a conventional image forming apparatus, there has been proposed a method of disposing a non-volatile memory in a unit, and causing the memory to store a history of use therein, thereby detecting whether the unit is new or old (Japanese Patent Application Laid-open No. H09-185236). In a color image forming apparatus having a plurality of such units (drum units), however, it is necessary to dispose a memory in each unit and at the same time, it is necessary to dispose a communicating portion with the memory at a location whereat each unit and an image forming apparatus main body are in contact with each other. Therefore, the costs of the apparatus and the unit have become high, and there has also been a problem in respect of the apparatus size and unit disposition.

In contrast, there has been proposed a method of judging by a fuse provided on a unit (drum unit) whether the unit is new or old (Japanese Patent Application Laid-open No. H05-61393 and Japanese Patent Application Laid-open No. H06-118736). This method is to detect the conducting state of the fuse of the unit mounted on an apparatus main body to thereby judge whether the unit is new or old, and when it judges the unit to be new, carry out a predetermined initializing process and cut the fuse. That is, an inexpensive fuse instead of a memory can be provided on the drum unit, and a unit new/old discriminating portion for detecting whether an electric current passes through the fuse, and a fuse fusing portion for supplying an overcurrent to the fuse can be provided in the apparatus main body. The unit new/old discriminating portion and the fuse fusing portion are both constituted by a relatively simple circuit and can therefore discriminate between the newness and oldness of the unit (drum unit) by inexpensive and simple structure.

However, the following problem arises when design is made such that as described above, the conducting state of the fuse provided on the unit is detected to thereby judge whether the unit is new or old, and when the unit is judged to be new, a predetermined initializing process is carried out and the fuse is cut.

For example, when a problem has arisen in an image formed by the image forming apparatus, it is necessary to discriminate whether the cause of the problem resides in the image forming apparatus main body or in the drum unit. Therefore, a serviceman or the user himself sometimes tries to mount a new drum unit on trial on an image forming apparatus main body in which a problem has arisen and check up the operation thereof. In this case, when the new drum unit is put into the apparatus, the image forming apparatus detects the newness of the drum and automatically performs the operation of initializing the drum, and adjusts a parameter in the interior of the machine to a state optimum for the new drum unit and also burns out the fuse of the drum unit. Thereafter, it outputs an image and checks up the operation, and if as the result, it is discriminated that the cause resides in the drum unit so far mounted, the new drum unit can be intactly used.

However, if conversely, it has been found that the cause resides in the image forming apparatus main body, a normal drum unit originally mounted on the apparatus becomes useless. That is, even if an attempt is made to return the normal drum unit originally mounted on the apparatus into the apparatus and use it, the control parameter has already been initialized so as to be optimum for the new drum unit at a point of time whereat the new drum unit has been mounted as a test. Therefore, the image forming apparatus cannot be used in a state optimum for the normal drum unit originally mounted on the apparatus. Also, the new drum unit used on trial has had its fuse cut and therefore, is not recognized as a new one even if it is newly mounted on other apparatus. Therefore, the initializing operation is not performed and the apparatus cannot be used in an optimum state.

SUMMARY OF THE INVENTION

It is an object of the present invention to provide an image forming apparatus, which can execute image formation always in a state optimized for a mounted image forming unit.

In order to achieve the above object, an image forming apparatus according to an embodiment of the present invention is an image forming apparatus for carrying out an image forming process with a detachably mountable image forming unit mounted thereon, having a mount detecting portion for detecting that the image forming unit has been mounted, a discriminating portion for discriminating, when the mounting of the image forming unit has been detected by the mount detecting portion, whether the mounted image forming unit is a new one, an information holding portion for holding unit control information corresponding to the image forming unit, and an information updating portion for updating the unit control information held by the information holding portion, on the basis of the result of the discrimination at the last time and this time by the discriminating portion.

By such a construction, image formation becomes executable always in a state optimized for the mounted image forming unit.

The above and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Some embodiments of the present invention will hereinafter be described with reference to the drawings.

Figure 1:
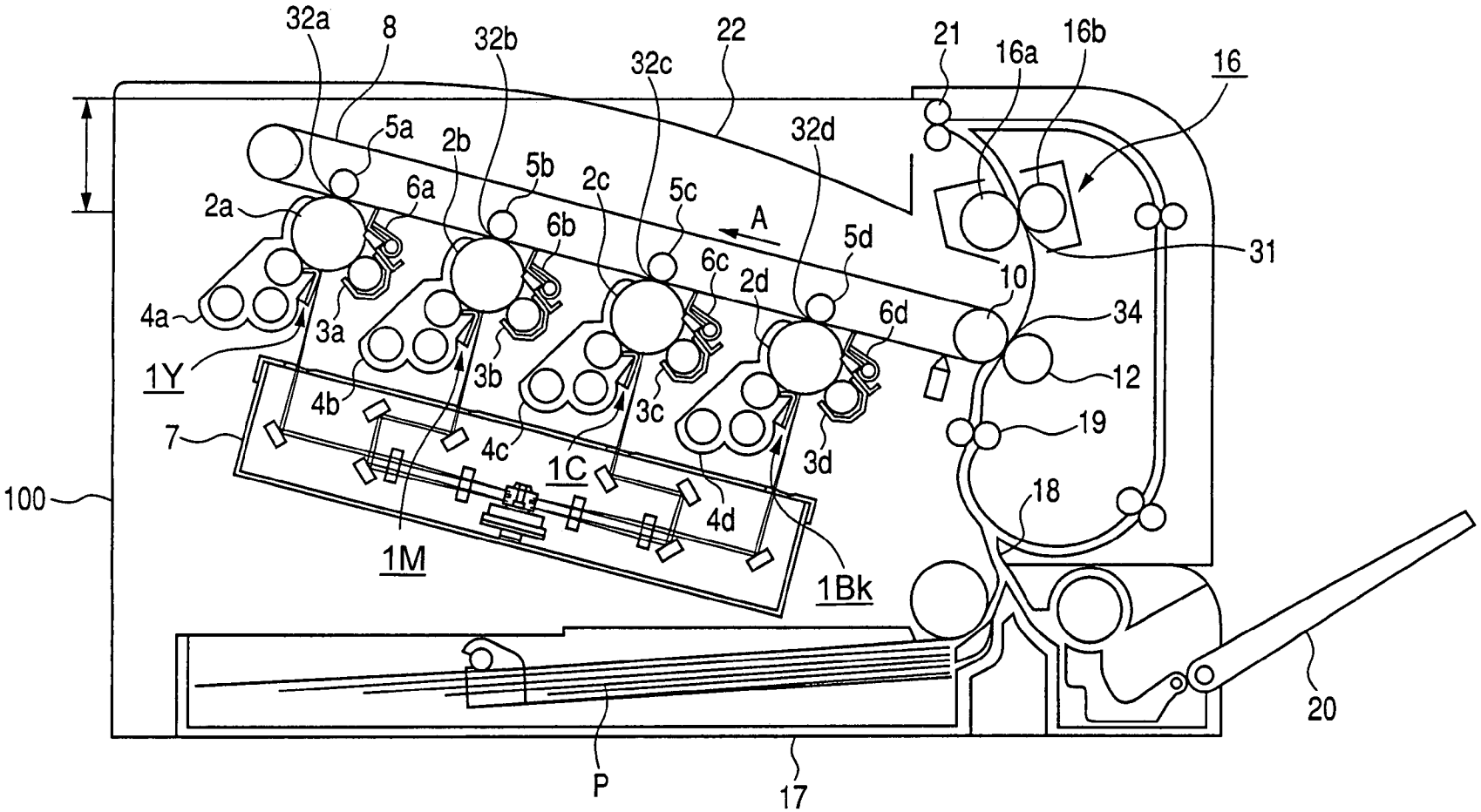
FIG. 1 is an illustrative cross-sectional view of an image forming apparatus according to an embodiment of the present invention.

FIG. 1 is an illustrative cross-sectional view of a color image forming apparatus. This color image forming apparatus is provided with four image forming portions (image forming units), i.e., image forming portions 1Y, 1M, 1C and 1Bk for forming yellow, magenta, cyan and black images, respectively. The four image forming portions 1Y, 1M, 1C and 1Bk are disposed in a row at predetermined intervals. Drum-shaped electrophotographic photosensitive members (hereinafter referred to as the photoconductive drums) 2*a*, 2*b*, 2*c* and 2*d* as image carrying members are installed in the image forming portions 1Y, 1M, 1C and 1Bk, respectively. Around the respective photoconductive drums 2*a*, 2*b*, 2*c* and 2*d*, there are disposed primary charges 3*a*, 3*b*, 3*c*, 3*d*, developing units 4*a*, 4*b*, 4*c*, 4*d*, transfer rollers 5*a*, 5*b*, 5*c*, 5*d* as transferring portions, and drum cleaner devices 6*a*, 6*b*, 6*c*, 6*d*. A laser exposing apparatus 7 is installed below the primary charging devices 3*a*, 3*b*, 3*c*, 3*d* and the developing units 4*a*, 4*b*, 4*c*, 4*d*. A yellow toner, a magenta toner, a cyan toner and a black toner are contained in the developing units 4*a*, 4*b*, 4*c* and 4*d*, respectively.

Description will now be made of the image forming operation of the above-described image forming apparatus.

When an image formation start signal is generated, the photoconductive drums 2*a*, 2*b*, 2*c* and 2*d* of the respective image forming portions 1Y, 1M, 1C and 1Bk rotatively driven at a predetermined process speed are uniformly charged to the negative polarity by the primary charging devices 3*a*, 3*b*, 3*c* and 3*d*, respectively. Then, the exposing apparatus 7 applies a color-separation image signal inputted from the outside from a laser beam emitting element, and forms electrostatic latent images for respective colors on the photoconductive drums 2*a*, 2*b*, 2*c* and 2*d* via a polygon lens, a reflecting mirror, etc.

Then, the yellow toner is caused to adhere to the electrostatic latent image formed on the photoconductive drum 2*a*, by the developing unit 4*a* to which a developing bias of the same polarity as the charging polarity (the negative polarity) of the photoconductive drum 2*a* has been applied, thereby visualizing the electrostatic latent image as a toner image. This yellow toner image is primary-transferred onto an intermediate transfer belt 8 being driven, by the transfer roller 5*a* to which a primary transfer bias (of a polarity (the positive polarity) opposite to that of the toners) has been applied in a primary transfer portion 32*a* between the photoconductive drum 2*a* and the transfer roller 5*a*.

The intermediate transfer belt 8 to which the yellow toner image has been transferred is moved to the image forming portion 1M side. Then, also in the image forming portion 1M, a magenta toner image formed on the photoconductive drum 2*b* is superposed on the yellow toner image on the intermediate transfer belt 8 and transferred to the intermediate transfer belt 8 in a primary transfer portion 32*b*, in the same manner described previously. At this time, any untransferred toners residual on the respective photoconductive drums 2 are scraped off and collected by cleaner blades or the like provided in the drum cleaner devices 6*a*, 6*b*, 6*c* and 6*d*.

Thereafter, in a similar manner, cyan and black toner images formed on the photoconductive drums 2*c* and 2*d* of the image forming portions 1C and 1Bk are successively superposed on the yellow and magenta toners superposed on and transferred to the intermediate transfer belt 8 in respective primary transfer portions 32*c*-32*d*. In the manner described above, a full-color toner image is formed on the intermediate transfer belt 8.

Then, in timed relationship with the movement of the leading edge of the full-color toner image on the intermediate transfer belt 8 to a secondary transfer portion 34 between a secondary transfer opposed roller 10 and a secondary transfer roller 12, a transfer material (paper) P is conveyed to the secondary transfer portion 34 by registration rollers 19. The transfer material (paper) P is selectively fed from a sheet supplying cassette 17 or a manually feeding tray 20 through a conveying path 18. The full-color toner image is collectively secondary-transferred to the transfer material P conveyed to the secondary transfer portion 34, by the secondary transfer roller 12 to which a secondary transfer bias (of the polarity (positive polarity) opposite to that of the toners) has been applied.

The transfer material P on which the full-color toner image has been formed is conveyed to a fixing device 16, and is heated and pressurized by a fixing nip portion 31 between a fixing roller 16*a* and a pressure roller 16*b*, whereby the full-color toner image is heat-fixed on the surface of the transfer material P. Thereafter, the transfer material P is discharged onto a sheet discharging tray 22 on the upper surface of a main body, thus completing a series of image forming operations.

Figure 2:
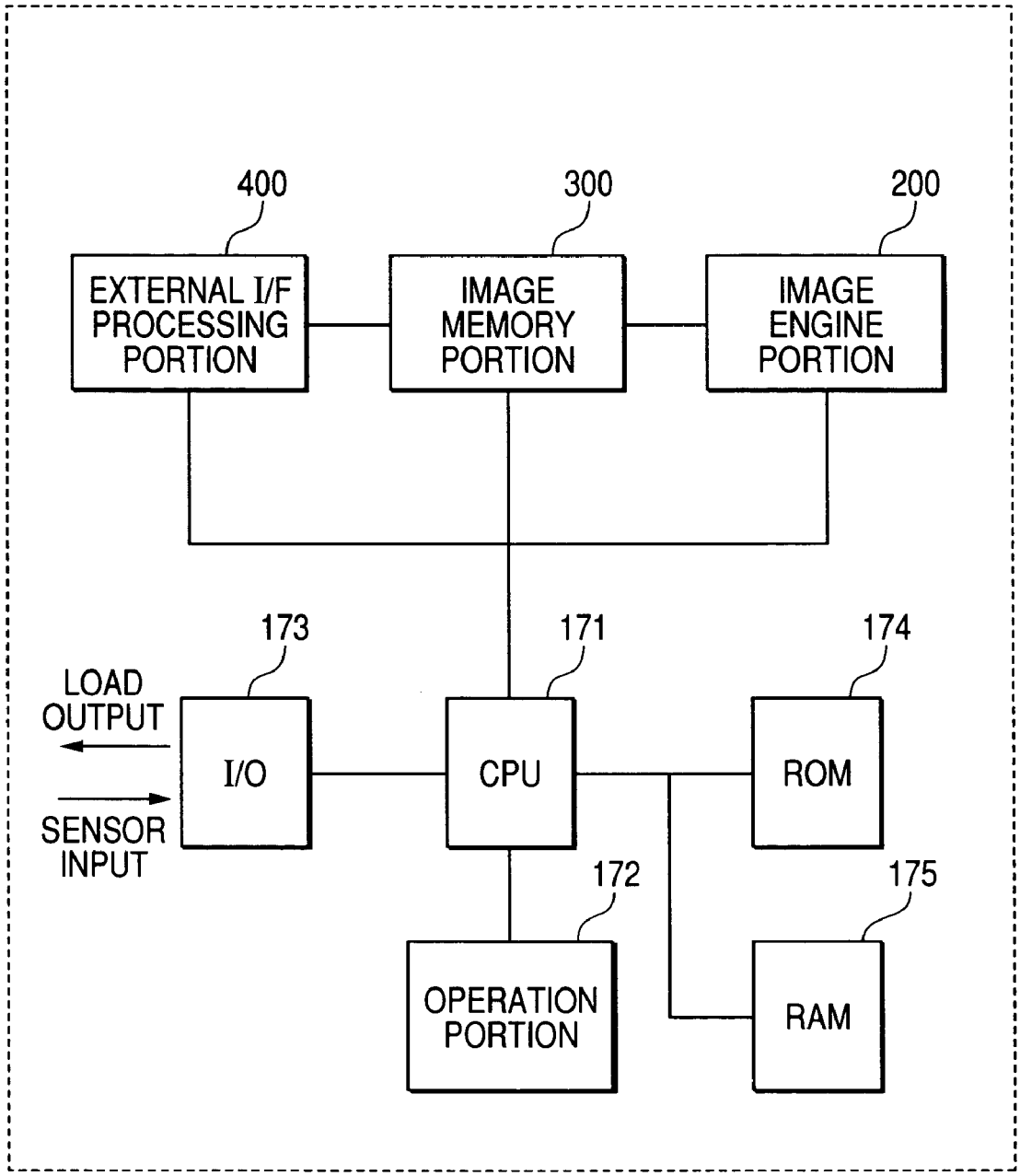
FIG. 2 is an illustrative control block diagram for controlling the image forming apparatus according to the embodiment of the present invention.

FIG. 2 is an illustrative control block diagram for controlling the color image forming apparatus according to the present embodiment. A CPU 171 which effects the basic control of the image forming apparatus 100 has connected thereto a ROM 174 having a control program written therein, a work RAM 175 for carrying out processing, and an input-output port I/O 173 by an address bus and a data bus. The input-output port I/O 173 has connected thereto various loads (not shown) such as a motor and a clutch constituting the image forming apparatus, and an input (not shown) such as a sensor for detecting the position of the paper.

The CPU 171 sequentially effects the control of an input and an output through the input-output port I/O 173 in accordance with the contents of the ROM 174, and executes the image forming operation. Also, the CPU 171 is connected to an operation portion 172, and controls the display portion and key input portion of the operation portion 172. An operator instructs the CPU 171 to change over an image forming operation mode and display, through the key input portion, and the CPU 171 effects the display of the state of the image forming apparatus 100 and the setting of the operation mode by a key input. The CPU 171 has connected thereto an external I/F processing portion 400, an image memory portion 300 and an image engine portion 200.

The external I/F processing portion 400 transmits and receives image data and processing data from an external device such as a personal computer (PC), and the image memory portion 300 is used for the expanding process of an image and temporary accumulation thereof. The image engine portion 200 carries out the process of exposing line image data forwarded from the image memory portion 300 by the exposing apparatus 7.

Figure 3:
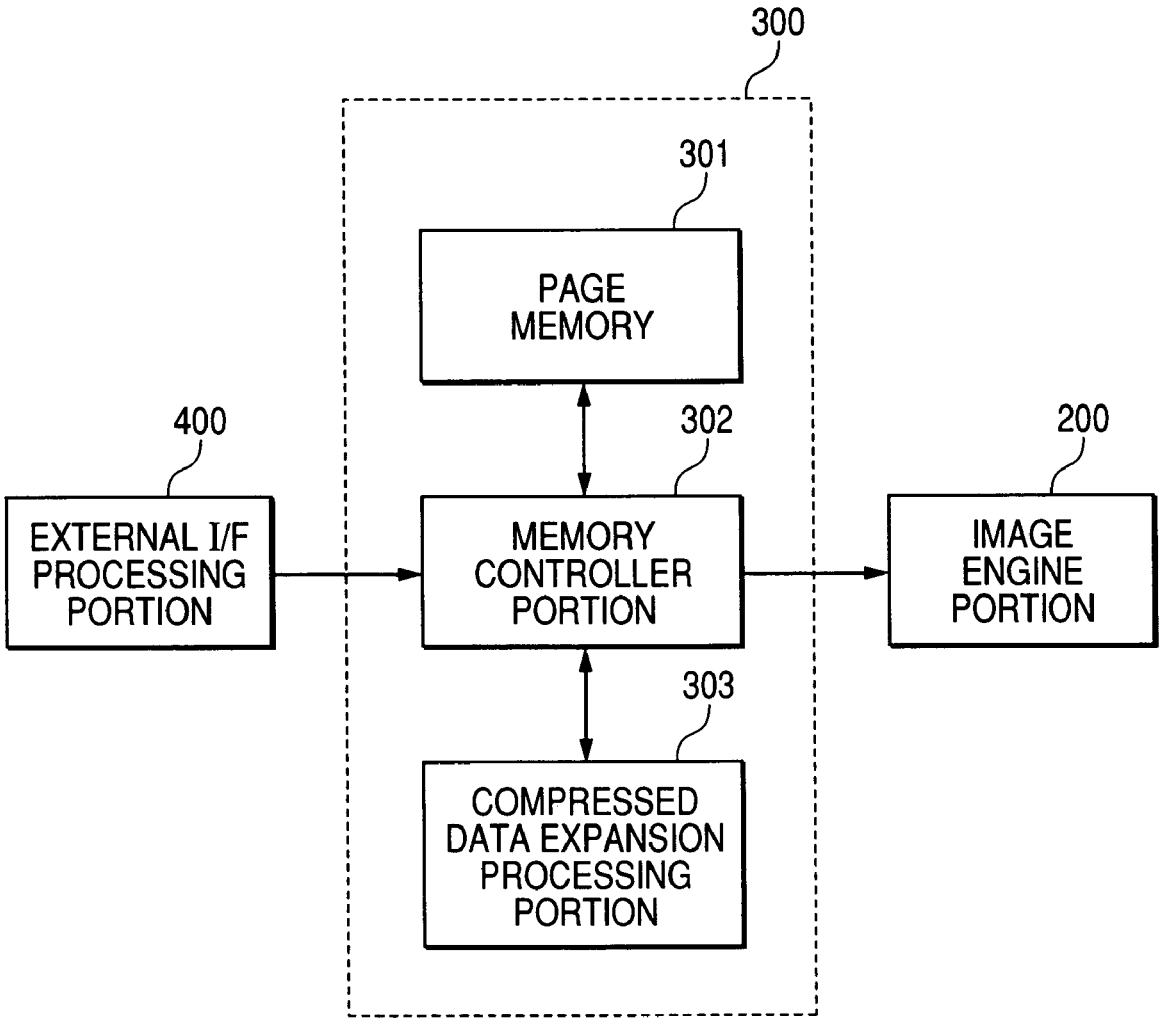
FIG. 3 shows the construction of the image memory portion of the image forming apparatus according to the embodiment of the present invention.

FIG. 3 is an illustrative control block diagram of the image memory portion 300 according to the present embodiment. In the image memory portion 300, a memory controller portion 302 effects the access of the inputting and outputting of the image. That is, it receives image data from the external I/F processing portion 400, writes the image data into a page memory 301 constituted by a DRAM or the like, and also reads out the image data stored in the page memory 301 to the image engine portion 200.

Also, the memory controller portion 302 judges whether the image data from the external device received from the external I/F processing portion 400 is compressed data. If the image data is judged to be compressed data, expansion processing is carried out by the use of a compressed data expansion processing portion 303, whereafter the writing process into the page memory 301 is executed. The memory controller portion 302 generates the DRAM refreshing signal of the page memory 301, and effects the adjustment of the access to the page memory 301 for the writing from the external I/F processing portion 400 and the reading-out to the image engine portion 200. Further, it effects the control of the writing-in address into the page memory 301, the reading-out address from the page memory 301, and the reading-out direction, in accordance with the instructions of the CPU 171.

Figure 4:
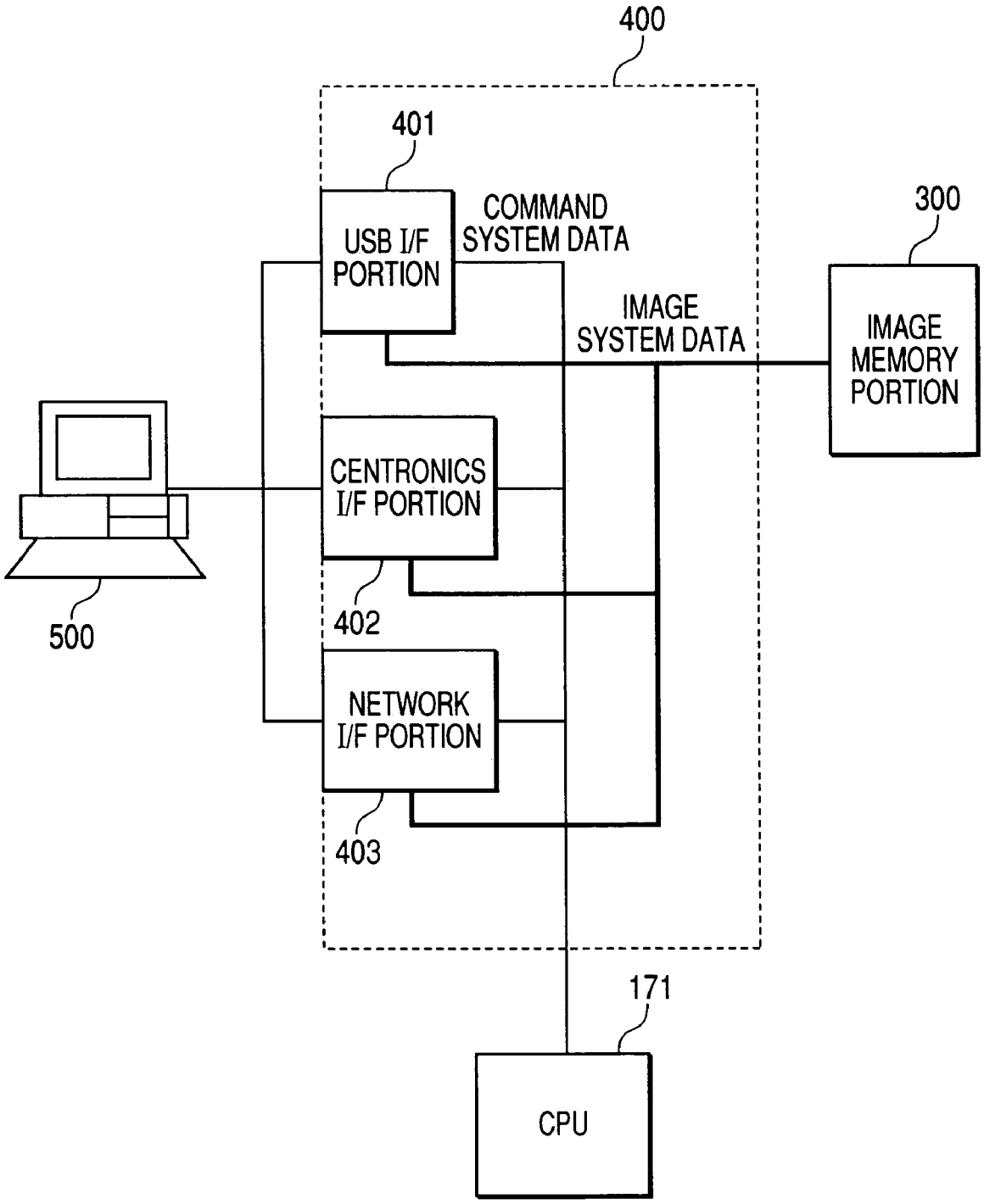
FIG. 4 shows the construction of the external I/F processing portion of the image forming apparatus according to the embodiment of the present invention.

The construction of the external I/F processing portion 400 will now be described with reference to FIG. 4. In the external I/F processing portion 400, image data and print command data transmitted from an external device 500 are received through any one of a USB I/F portion 401, a centronics I/F portion 402 and a network I/F portion 403. Also, the external I/F processing portion 400 transmits the state information or the like of the image forming apparatus judged by the CPU 171 to the external device 500. The external device 500 is a computer, a work station or the like.

The CPU 171 processes the print command data received from the external device 500 through any one of the USB I/F portion 401, the centronics I/F portion 402 and the network I/F portion 403, and effects the control of the setting and timing of the printing operation by the image engine portion 200. The image data received from the external device 500 through any one of the USB I/F portion 401, the centronics I/F portion 402 and the network I/F portion 403 is transmitted to the image memory portion 300 at the timing based on the print command data. Then, in the image memory portion 300, the image data is processed to be formed into an image by the image engine portion 200.

Figure 5:
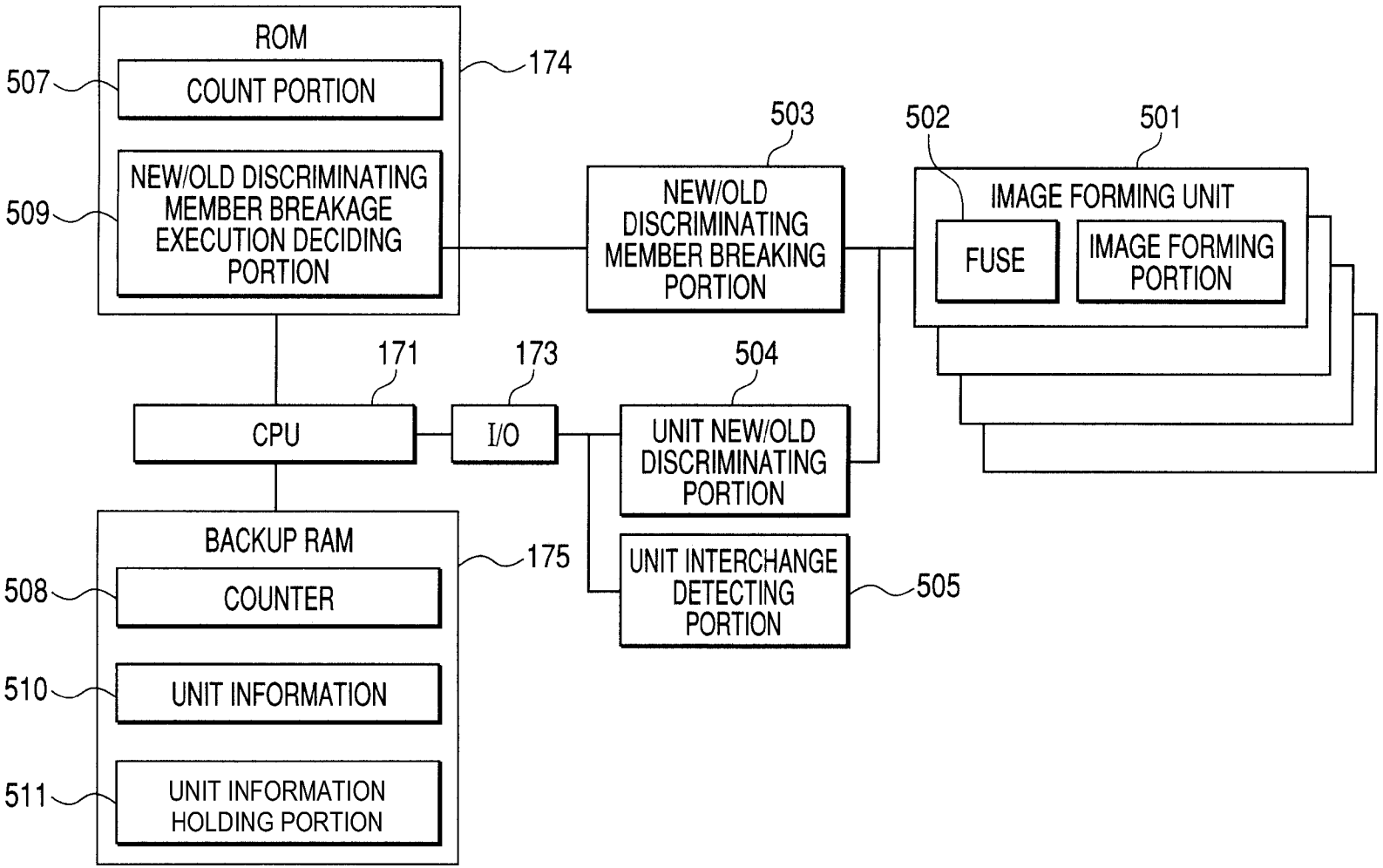
FIG. 5 shows the construction of the image forming apparatus according to the present embodiment.

FIG. 5 shows the construction of an image forming system in the present embodiment. An image forming unit 501 is a unit comprising the photoconductive drum 2, the primary charging device 3, the developing unit 4 and the drum cleaner device 6. Also, the image forming unit 501 is designed to be detachably mountable on the image forming apparatus main body with Y, M, C and K colors independent of each other.

This image forming unit 501 is further provided with a fuse 502 as a unit new/old discriminating member. The fuse 502 is disposed at a location in the end portion of the image forming unit 501 and contacting with the image forming apparatus. A new/old discriminating member breaking portion 503 is an electric current output circuit for supplying an overcurrent to the fuse 502 to thereby burn out the fuse 502.

A unit new/old discriminating portion 504 is a sensor for detecting an electric current flowing from one end of the fuse 502 at the other end thereof. When it is detected by the unit new/old discriminating portion 504 that the fuse 502 is conducting, the fuse 502 is not burned out and therefore, it is judged (discriminated) that the unit is new. When it is not detected that the fuse 502 is conducting, the fuse 502 is burned out and therefore, it is judged (recognized) that the unit is old. Also, the result detected by the unit new/old discriminating portion 504 is informed to the CPU 171 through the input/output port 173.

A unit interchange detecting portion 505 detects whether the unit has been interchanged. In the present embodiment, design is made such that when the interchange of the unit is to be effected, the upper cover of the image forming apparatus is opened and closed. Also, the image forming apparatus has a physical mechanism for memorizing the opening operation of the upper cover. So, when the opening of the upper cover has been detected by the physical mechanism, it is judged that there is the possibility that the unit has been interchanged.

A count portion 507 measures the frequency (frequency of operation) with which image formation has been effected after each image forming unit 501 has been mounted on the image forming apparatus, or the time (working time) for which image formation has been effected, and the result of the measurement is stored in a counter 508. A new/old discriminating member breakage execution deciding portion 509 instructs the new/old discriminating member breaking portion 503 to fuse the fuse 502, in accordance with the result of the discrimination by the unit new/old discriminating portion 504 and the value of the counter 508.

Unit information 510 is parameter information for effecting image formation in accordance with the characteristic of each image forming unit 501. The unit information 510 is determined in accordance with the result of an initializing operation performed when the image forming unit 501 has been mounted on the image forming apparatus for the first time.

In the present embodiment, toner density adjusting control is effected to keep the mixing ratio of a toner and a carrier in the developing unit 4 in a proper state. In this control, a toner pattern is formed on the intermediate transfer belt 8, and the formed pattern is read by a sensor to thereby detect the density of the pattern. Then, the supply amount of the toner from a toner cartridge to the developing unit 4 is adjusted in accordance with the detected density of the pattern to thereby control the mixing ratio of the toner and the carrier in the developing unit 4.

When this control is effected, the density target value of the pattern formed on the intermediate transfer belt 8 is the density of a toner pattern formed on the intermediate transfer belt 8 in the initializing operation performed when the image forming unit 501 has been mounted on the image forming apparatus for the first time. This target value is stored in a non-volatile RAM area in the image forming apparatus as the unit information 510 conforming to the characteristic of each image forming unit 501.

A unit information holding portion 511 is for storing (saving) therein the unit information 510 of the image forming unit used (mounted) previously for a predetermined period when the image forming unit 501 has been interchanged, and like the unit information 510, it is constructed in the non-volatile RAM area in the image forming apparatus.

Figure 6:
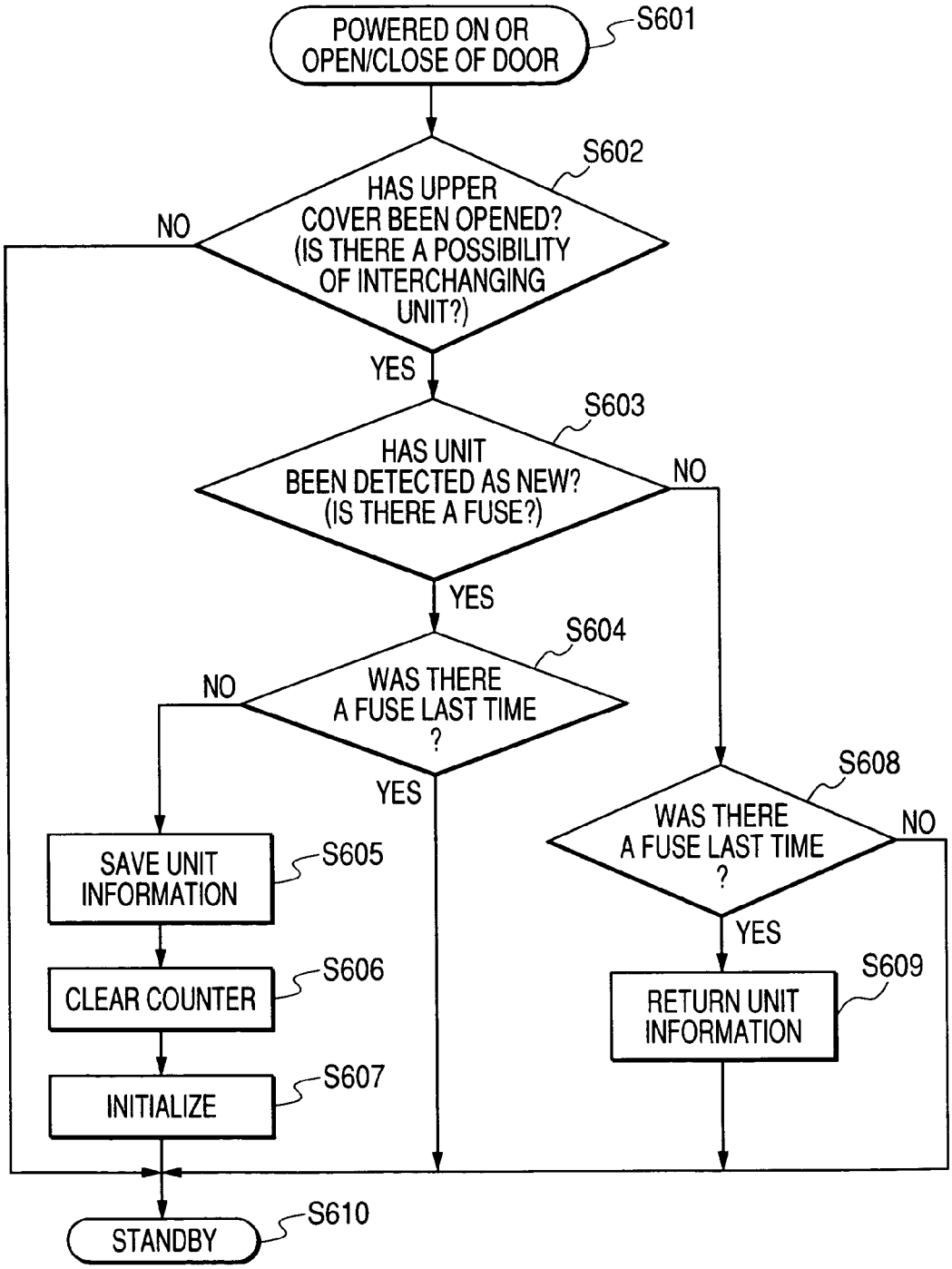
FIG. 6 is a flow chart of the operation of discriminating between the newness and oldness of an image forming unit in the present embodiment.

FIG. 6 shows a flow chart of the new/old discriminating operation of the image forming unit 501 in the present image forming apparatus.

When at S601, the power supply of the image forming apparatus is switched on or the cover of the image forming apparatus is opened and closed, there is the possibility that the image forming unit 501 in the image forming apparatus has been interchanged and therefore, check-up is started. As described above, in the present embodiment, when the interchange of the unit is to be effected, it is necessary to open and close the upper cover, which is the cover of the image forming apparatus. Also, the image forming apparatus has the physical mechanism for memorizing the opening operation of the upper cover. Whether the upper cover has been opened and closed can be detected by this physical mechanism.

At S602, whether the upper cover has been opened is detected. If it is detected that the upper cover has been opened, it is judged that the image forming unit 501 has been interchanged, and the new/old discrimination control of the image forming unit is started.

At S603, the unit new/old discriminating portion 504 checks up whether the fuse 502 is conducting, and discriminates the newness or oldness of the image forming unit 501. The result detected by the unit new/old discriminating portion 504 is informed to the CPU 171 through the input-output port 173.

If it is detected by the unit new/old discriminating portion 504 that the image forming unit 501 is new, at S604, reference is made to the state of the fuse 502 of the image forming unit 501 mounted the last time which is stored in the non-volatile RAM area in the interior of the image forming apparatus.

When the state of the fuse 502 at the last time indicates a new one (that the fuse is not burned out), the image forming unit 501 is new and has not been interchanged, or has been interchanged to another new image forming unit 501 and therefore, the update of the unit information 510 is not effected.

On the other hand, when the state of the fuse 502 at the last time indicates an old one (that the fuse is cut), it is judged that the image forming unit 501 has been interchanged from an old one to a new one.

When it is judged that the image forming unit 501 has been interchanged from an old one to a new one, at S605, the unit information 510 of the image forming unit mounted the last time is copied and stored in the unit information holding portion 511.

Further, at S606, the value of the counter 508 which provides the reference for deciding whether the fuse 502 should be burned out is cleared.

Thereafter, at S607, the initializing operation for determining the unit information 510 for effecting image formation in accordance with the characteristic of each newly mounted image forming unit 501 is performed, and at a point of time whereat the initializing operation has been terminated, the image forming apparatus assumes a standby state.

On the other hand, if at 603, the unit new/old discriminating portion 504 discriminates that the fuse 502 is not conducting, at S608, reference is made to the state of the fuse 502 of the image forming unit 501 mounted the last time which is stored in the interior of the image forming apparatus. When the state of the fuse 502 at the last time indicates an old one, the image forming unit 501 is an old one and has not been interchanged, or has been interchanged to another old image forming unit 501 and therefore, the update of the unit information 510 is not effected.

In contrast, if at S608, the state of the fuse 502 at the last time indicates a new one, it is judged that the fuse 502 has been returned to the previous image forming unit 501 before the fuse is cut, and at S609, the information stored in the unit information holding portion 511 is copied and stored in the unit information 510. That is, the unit information 510 copied and stored (saved) in the unit information holding portion 511 at S605 is returned from the unit information holding portion 511 to the unit information 510.

By doing so, image formation at the applied charging potential conforming to the current image forming unit, particularly drum, and a table for converting image data into density information becomes possible. Thereafter, at a point of time whereat the update of the unit information 510 has been terminated, the image forming apparatus assumes a standby state.

Figure 7:
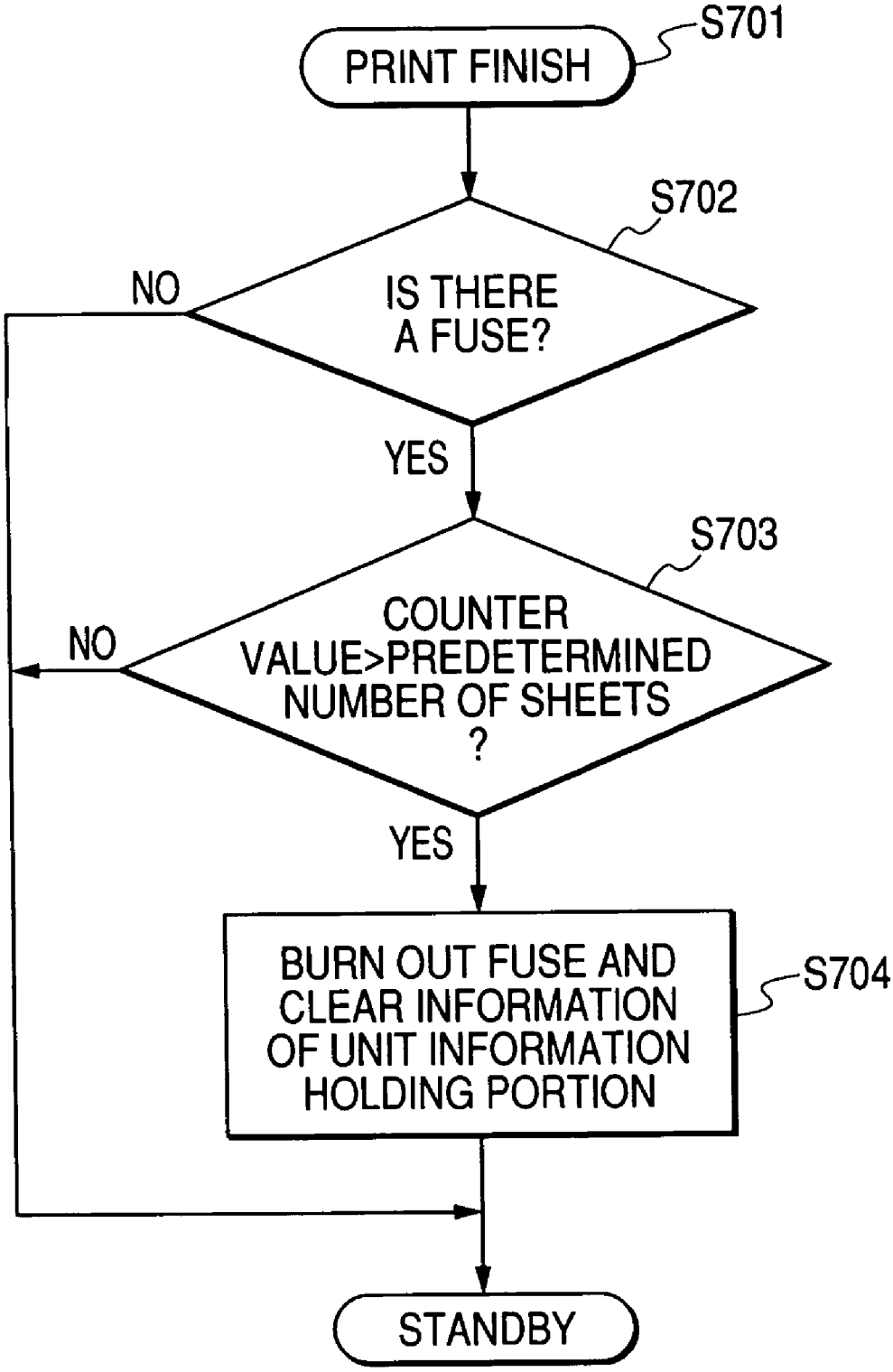
FIG. 7 is a flow chart of the fuse burning-out operation of the image forming unit in the present embodiment.

Reference is now had to the flow chart of FIG. 7 to describe the flow of the fuse burning-out operation of the image forming unit 501.

The image forming apparatus counts up the value of the counter 508 each time it effects image formation.

When at S701, the image forming apparatus finishes its image forming process, advance is made to S702 in order to judge whether the fuse 502 of the image forming unit 501 should be burned out when the apparatus is stopped.

At S702, the unit new/old discriminating portion 504 checks up whether the fuse 502 is conducting, and discriminates between the newness and oldness of the image forming unit 501.

If it is discriminated that the image forming unit is new (the fuse 502 is not burned out), at S703, the new/old discriminating member breakage execution deciding portion 509 judges whether the value of the counter 508 has reached a predetermined condition. In the present embodiment, it is the condition for burning out the fuse 502 that a predetermined number of sheets (50 sheets) of image formation has been effected from a point of time at which the image forming unit 501 has been interchanged to a new one.

If the new/old discriminating member breakage execution deciding portion 509 judges that the value of the counter 508 has reached a predetermined condition, that is, the counter value has reached a predetermined or greater number of sheets, instructions to fuse the fuse 502 is given to the new/old discriminating member breaking portion 503, and the fuse 502 is burned out (S704).

That is, design is made such that fusing is selectively not executed until a predetermined number of sheets is reached, whereby even if a new drum unit used as a test is used in another apparatus, it can be recognized as a new one. Also, it becomes possible to improve the usability by a serviceman or the user, and improve the working property when effecting the maintenance of the apparatus.

Other Embodiments

While in the present embodiment, a fuse is used as a new/old discriminating member capable of discriminating physical breakage, the construction of the present invention can also be realized by a construction which effects the detection of the newness or oldness of a unit by other physical breakage.

For example, a light emitting element and a light receiving element are disposed in an image forming apparatus, and a reflecting plate is disposed on a unit side. Further, a member constructed physically breakably and intercepting light is provided between the light emitting and receiving elements of the image forming apparatus and the reflecting plate of the unit.

Thereby, it is possible to judge that if light emitted by the light emitting element of the image forming apparatus returns to the light receiving element, it is judged that the intercepting member has been broken and the unit is old, and to judge that if the light emitted by the light emitting element does not return to the light receiving element, the intercepting member is attached and the unit is new.

Also, while in the present embodiment, an image forming unit has been described as a unit detachably mountable on an image forming apparatus main body, the unit to which the present invention is applicable may be only a photoconductive drum, and it is also possible to apply the present invention to the detection of the newness or oldness of not only an image forming portion, but also a toner cartridge.

Besides, the present invention can also be applied to any interchangeable unit such as, for example, a fixing unit.

This application claims priority from Japanese Patent Application No. 2004-334802 filed Nov. 18, 2004, which is hereby incorporated by reference herein.

What is claimed is:

1. An image forming apparatus, which carries out an image forming process with a detachably mountable image forming unit mounted thereon, said image forming apparatus comprising:

a mount detecting portion, which detects whether the image forming unit is mounted;

a discriminating portion, which discriminates, when a mounting of the image forming unit is detected by said mount detecting portion, whether the mounted image forming unit is new;

an information holding portion, which holds unit control information corresponding to the image forming unit; and an information updating portion, which updates the unit control information held by said information holding portion, based on discrimination results from a previous detection and a current detection by said discriminating portion, wherein when the discrimination result based on the previous detection by said discriminating portion is not new and the discrimination result based on the current detection by said discriminating portion is new, the information updating portion backs up the unit control information corresponding to the image forming unit at the previous detection held by said information holding portion, when the discrimination result based on the previous detection by said discriminating portion is new and the discrimination result based on the current detection by said discriminating portion is not new, the information updating portion updates the unit control information so that the previously backed-up unit control information corresponds to the image forming unit at the current detection, and wherein when the discrimination result based on the previous detection and the discrimination result based on the current detection by said discriminating portion are the same, said information updating portion maintains the unit control information held by said information holding portion.

2. An image forming apparatus according to claim 1, wherein said discriminating portion discriminates whether the mounted image forming unit is new, based on a physical state of a discrimination member provided in the image forming unit.

3. An image forming apparatus according to claim 2, wherein when the discrimination member is in a first state, said discriminating portion discriminates that the image forming unit is new, and when the discrimination member is in a second state, said discriminating portion discriminates that the image forming unit is not new.

4. An image forming apparatus according to claim 3, further comprising a changing portion, which changes, when the discrimination member is in the first state, the first state to the second state.

5. An image forming apparatus according to claim 4, wherein when said changing portion changes the discrimination member from the first state to the second state, said information updating portion updates the unit control information held by said information holding portion.

6. An image forming apparatus according to claim 2, wherein the discrimination member includes a fuse.

7. An image forming apparatus according to claim 1, further comprising a counter, which counts a number of operations of the image forming unit, wherein when said discriminating portion determines that the mounted image forming unit is new, a count value of said counter is cleared.

8. An image forming apparatus according to claim 1, wherein the image forming unit includes a photoconductive drum.

9. An image forming apparatus according to claim 8, wherein the unit control information held by said information holding portion includes a toner density target value.

* * * * *